US009308146B2

(12) United States Patent
Shan

(10) Patent No.: US 9,308,146 B2
(45) Date of Patent: Apr. 12, 2016

(54) ELECTRIC BED BEDBOARD WITH EMBEDDED FIXED STRUCTURE

(71) Applicant: Huafeng Shan, Jiaxing (CN)

(72) Inventor: Huafeng Shan, Jiaxing (CN)

( * ) Notice: Subject to any disclaimer, the term of this patent is extended or adjusted under 35 U.S.C. 154(b) by 570 days.

(21) Appl. No.: 13/889,994

(22) Filed: May 8, 2013

(65) Prior Publication Data

US 2013/0326814 A1 Dec. 12, 2013

(30) Foreign Application Priority Data

Nov. 6, 2002 (CN) ..... 2012 2 0579701 U
Nov. 6, 2012 (CN) ..... 2012 1 0437918
Nov. 6, 2012 (CN) ..... 2012 2 0578409 U
Nov. 6, 2012 (CN) ..... 2012 2 0579554 U
Nov. 6, 2012 (CN) ..... 2012 2 0579637 U

(51) Int. Cl.

*A61G 7/015* (2006.01)
*A47C 21/00* (2006.01)
*A61G 7/002* (2006.01)
*A47C 20/00* (2006.01)
*A47C 21/02* (2006.01)

(52) U.S. Cl.

CPC ..... *A61G 7/002* (2013.01); *A47C 20/00* (2013.01); *A47C 21/026* (2013.01); *A61G 7/015* (2013.01)

(58) Field of Classification Search

CPC ..... A61G 7/015; A61G 7/018; A61G 7/05; A47C 21/026; A47C 21/02; A47C 21/00
USPC ..... 5/613, 600, 659, 658, 411, 400, 694, 5/691, 690, 722, 723
See application file for complete search history.

(56) References Cited

U.S. PATENT DOCUMENTS 2,588,854 A * 3/1952 Lang ..... A61G 7/015 5/411
2,995,762 A * 8/1961 Albinson ..... A47C 23/00 5/133
3,769,643 A * 11/1973 Adler ..... A47C 21/06 5/401
7,607,181 B1 * 10/2009 Harrison ..... A47C 21/026 5/411
7,810,194 B2 * 10/2010 Clenet ..... A47C 21/003 5/659
8,646,130 B2 * 2/2014 Alzoubi ..... A47C 20/04 5/193
9,003,583 B2 * 4/2015 Schnake ..... A61G 7/05 5/411
2008/0263775 A1 * 10/2008 Clenet ..... A47C 21/003 5/694
2012/0017373 A1 * 1/2012 Alzoubi ..... A47C 20/04 5/613
2013/0326814 A1 * 12/2013 Shan ..... A61G 7/002 5/613
2014/0123392 A1 * 5/2014 Shan ..... A47C 21/026 5/618
2014/0304914 A1 * 10/2014 Schnake ..... A61G 7/05 5/600

* cited by examiner

*Primary Examiner* — Robert G Santos
(74) *Attorney, Agent, or Firm* — Clement Cheng

(57) ABSTRACT

This invention discloses an electric bed bedboard with embedded fixed structure. The fixed structure includes a plurality of guide pieces, multiple sliders, multiple disc sleeves and two pieces of wood, a plurality of guide pieces. Multiple guide pieces are set on top of the bedboard and also have T-shaped slots on their surface. Many disc sleeves are stacked on top of the wood pieces at intervals and there are internal threads inside the disc sleeves. Two pieces of wood are fixed into the bed support at intervals and the disc sleeves' positions matches with the guide pieces. Multiple sliders are "stem" shaped sliders and have external threads on their top. Multiple sliders are situated on top of the guide pieces inside the T-shaped grooves. Multiple sliders' tops are situated inside the multiple disc sleeves which are connected by the threads.

7 Claims, 2 Drawing Sheets

ELECTRIC BED BEDBOARD WITH EMBEDDED FIXED STRUCTURE

This application is being filed within 12 months of the filing date of its parent application and accordingly claims Paris Convention priority from China patent application 201220578409.8 filed Jun. 11, 2012 entitled Electric Bed Bed board With Embedded Fixed Structure by same inventor Shan, Huafeng, the disclosure of which is incorporated herein by reference.

FIELD OF THE INVENTION

The present invention is in the field of electric bed bedboard with fixed connection structure.

DISCUSSION OF RELATED ART

An average person spends about one-third of their life in sleep; and thus, more and more attention has been put to achieve quality sleep by choosing the right bed that can bring people comfortable and healthy sleep. In order to meet the needs of the people, various types of electric beds came into widespread usage.

The traditional electric bed bedboard angle adjustment that allows the bed board to rise in the bedplate mattress easily slips from the foot of the bed due to the lack of friction in the bed board. To solve this technical problem, the angle of the electric bed may be adjusted so that it is installed at the foot of the bed frame above the mattress. In the process of rising and lowering, the bed frame may act as a barrier so that slipping is prevented. There are some shortcomings to this approach, such as the foot of the bed parts can not merely stay still which affects the overall appearance of the electric bed.

Also, mattresses are blocked by the frame when the bedboard is lifted several times. Mattress and mattress displacement may cause the bedplate to rise. There is no guarantee that the mattress and the bedplate is a good fit in the S-shaped angle. These shortcomings reduce the comfort of the electric bed, and hinder the beneficial effects of an electric bed.

Traditional electric beds have a hinged multi-piece bedplate. A variety of different traditional electric beds have been patented such as inventor David Hensley's articulating bed frame U.S. Pat. No. 6,006,379 issued Dec. 28, 1999, the disclosure of which is incorporated herein by reference. The typical bed having four planks hinged to each other may have poor connection between the mattress and the bed boards. Bedboards are also called bedplates.

SUMMARY OF THE INVENTION

This invention discloses an electric bed bedboard with embedded fixed structure. The fixed structure includes a plurality of guide pieces, multiple sliders, multiple disc sleeve and two pieces of wood, a plurality of guide pieces. Multiple guide pieces are set on top of the bedboard and also have T-shaped slots on their surface. Many disc sleeves are stacked on top of the wood pieces at intervals and there are internal threads inside the disc sleeves. Two pieces of wood are fixed into the bed support at intervals and the disc sleeves position matches with the guide pieces. Multiple sliders are "stem" shaped sliders and have external threads on their top. Multiple sliders are situated on top of the guide pieces inside the T-shaped slots. Multiple sliders' tops are situated inside the multiple disc sleeves which have connection by the threads. The fixed structure allows the mattress reliable formation to align with the bed plate, to avoid the slipping of the mattress bed plate during the lifting process, to improve the comfort of the electric bed, and to ensure the overall appearance and effect of the electric bed.

The present invention discloses an electric bed bedboard with embedded fixed structure; wherein the mattress can reliably be fixed to the bedplate to avoid slipping during the bedplate lifting process. This method allows for continued comfort, and ensures the overall appearance and effect of the electric bed.

The present invention of an electric bed bedboard with embedded fixed structure comprises a plurality of guide pieces, a plurality of sliders, a plurality of discs and two pieces of wood, which are located in the headboard and the top opened T-shaped slot, respectively.

This invention includes: a plurality of disc sleeves in the two pieces of wood and sleeve inner rings, two pieces of fixed wood embedded in the mattress and multiple disc sleeve position, a plurality of guide pieces, a plurality of stem shaped sliders, and a plurality of sliders located at the bottom of a plurality of T-shaped slots of the top surface of the guide pieces.

The origin of the terminology of element name 'stem shaped slider' is that the word 'stem' is derived from the shape of a Chinese character. The Chinese character for the word 'stem' is similar to the shape of English letter T with a strike through which is approximately similar to the cross-section of the part shown in the drawing. The Chinese character for the word 'stem' is similar to the letter F as well in that it has a terminal point of a vertical line with two pairs of horizontal lines normal to that terminal point. The Chinese character for stem can be seen in the parent application and the Chinese patent application 201220578409.8 filed Jun. 11, 2012 entitled Electric Bed Bed Board With Embedded Fixed Structure by same inventor and is hereby incorporated by reference for cross-reference. The Chinese word for stem is pronounced 'gan' and is upside down for purposes of this illustration because the stem tip should be pointing upward to secure to the bed frame while the stem flat portion should be pointing downward to connect to the T-shaped slot of the guide piece. The Chinese character has been translated to the English word stem as a translation by meaning, and the significance is the shape. The pictographic nature of Chinese characters suggests that the Chinese character was derived from a drawing of a stem.

The above-mentioned plurality of guide pieces, a plurality of sliders, and a plurality of disc sleeves, involves at least four items. One end of the T-shaped slot of the guide pieces is a bell-shaped opening.

Further, the electric bed bedboard with embedded fixed structure comprises a plurality of washers wherein the top surface of a plurality of washers is located in two boards. It is positioned to complement a plurality of disc sleeves. The washer disc sleeves are bolted through the wood fastening in a clamping installation to ensure the reliability of positioning, and to avoid drilling damage.

The electric bed bedboard with embedded fixed structure includes: a plurality of guide pieces, multiple sliders, multiple disc sleeves and two pieces of wood, a plurality of guide pieces at the top surface of the open T-slots, multiple disc sleeves in two pieces of wood and in the sleeve inner rings, two pieces of wood embedded in the mattress. Wherein the multiple disc sleeves, plurality of guide pieces, and multiple "stem" shaped sliders are located at the bottom of a plurality of guide pieces which are located at the top surface of the T-shaped slots. The fixed structure allows the mattress reliable formation that complements the bed plate, to avoid the slipping of the mattress during the lifting process, to improve the comfort of the electric bed, and to ensure the overall appearance and effect of the electric bed.

An electric bed bedboard with embedded fixed structure is characterized in that the fixed structure comprises a plurality of guide pieces, a plurality of sliders, a plurality of disc sleeves, two planks of wood, a plurality of guide pieces, located at the headboard and the top surface of the open T-slots, respectively. The two pieces of wood and sleeve inner rings with a plurality of disc sleeves complements the plurality of "stem" shaped sliders. The plurality of sliders and plurality of guide pieces at the top surface of the T-shaped slots are located in inside the sleeve and the threaded connection.

There are two guide pieces, namely a first guide piece and a second guide piece. There are two sliders, namely a first slider and a second slider; and wherein there are two disc sleeves, namely a first disc sleeve and a second disc sleeve. The first guide piece and the second guide piece are arranged along an edge of the bed mattress. The electric bed bedboard with embedded fixed structure has an electric bed bedboard with embedded fixed structure having a T-shaped slot at one end of the guide piece. The electric bed bedboard has a plurality of washers located at the top surface of two boards to complement the position of a plurality of disc sleeves through a fastened bolt between the washer and the disc sleeve.

The following call out list of elements provides a reference for the reference numbers of the drawings.

1 Bed Board
2 Plank Of Wood
31 T-Shaped Slot
32 Trumpet Shaped Opening
3 Guide Block
4 Sliders
41 Outer Thread
5 Disc Sleeve
6 Board
7 Washer

DETAILED DESCRIPTION OF THE PREFERRED EMBODIMENT

Figure 1:
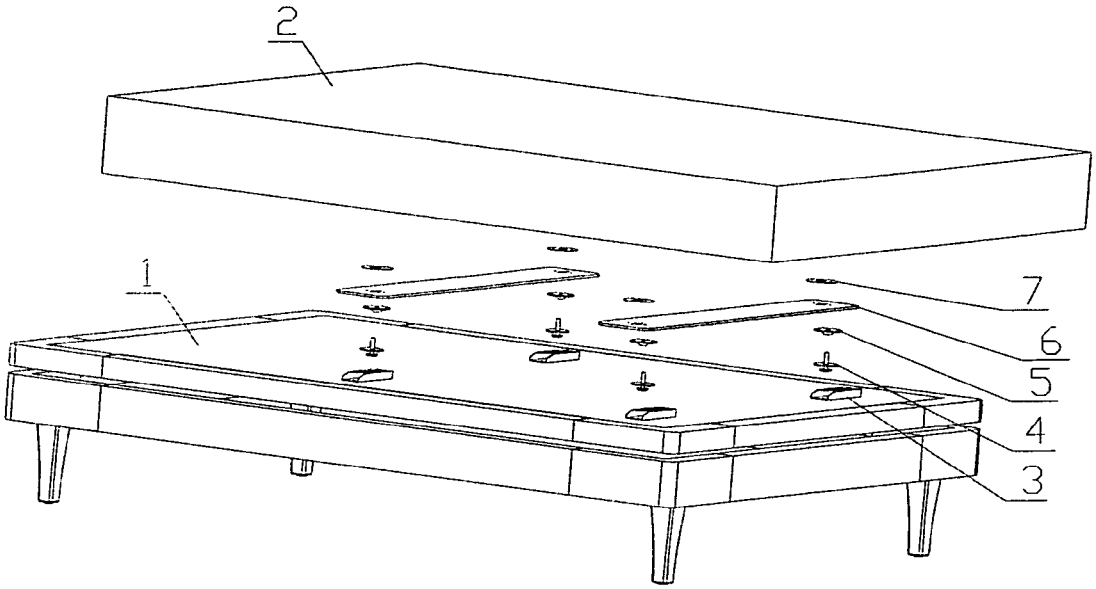
FIG. 1 is an exploded view.
Figure 2:
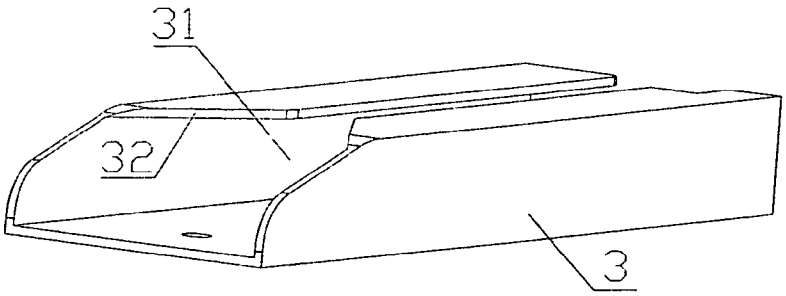
FIG. 2 is a side view of the guide piece.
Figure 4:
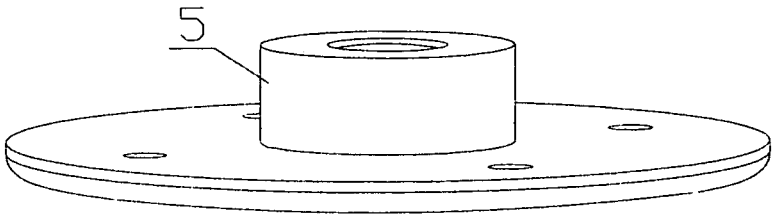
FIG. 4 is a front view of the disc sleeve.
Figure 3:
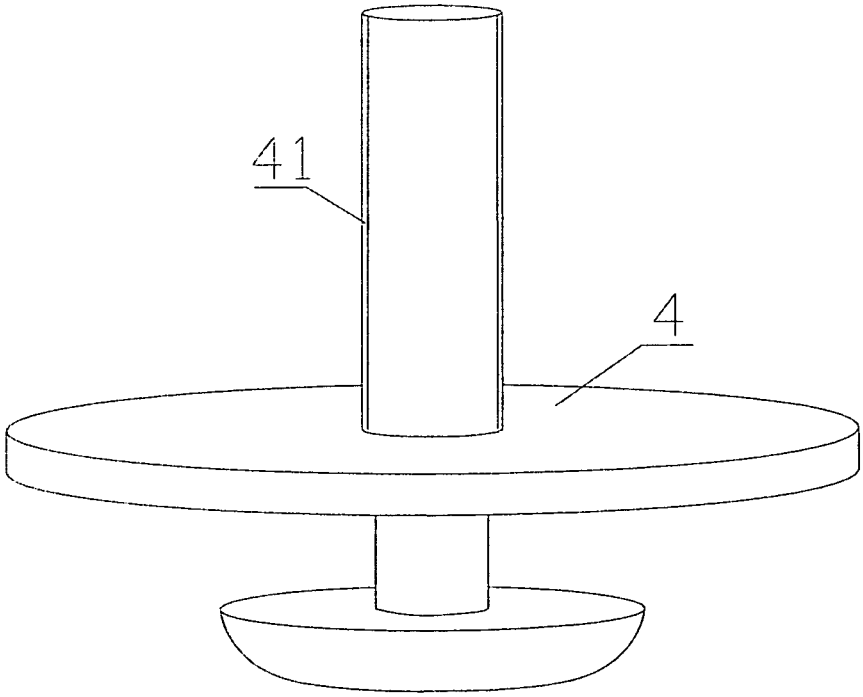
FIG. 3 is a front view of the slider.

As shown in FIG. 1, FIG. 2, FIG. 3 and FIG. 4 above, the present invention of an electric bed bedboard with an embedded fixed structure includes a plurality of guide pieces 3, a plurality of sliders 4, a plurality of disc sleeves 5 and two pieces of wood. The plurality of guide pieces 3 on bedboard 1 has a T-shaped slot 31 and the top surface of the plurality of disc sleeves 5 is located in the two pieces of wood on the sleeve inner ring. The two pieces of wood 2 and the disc sleeve 5 position and the plurality of guide pieces 3 position complements the plurality of "stem" shaped sliders 4 and the top of the outer thread 41 is provided, wherein a plurality of the sliders 4 are located at the bottom of a plurality of guide pieces at the top surface of the T-shaped slot 31. A plurality of the sliders 4 are located within the disc sleeve 5 at the threaded connection where the threaded connection threads connect together the disc sleeve to the slider on the outer thread 41.

Additionally, there can be at least four sets of connectors comprising the plurality of guide pieces 3, the plurality of sliders 4, and the plurality of disc sleeve 5.

Additionally the guide pieces 3 can have a T-shaped slot 31 with an end being a trumpet shaped opening 32. The trumpet shaped opening provides an easier insertion of the mattress onto the guide pieces. The guide pieces 3 are elongated and have an elongated channel with a top portion of the elongated channel cut with a slot such that a T-shaped slot 31 is formed. The guide pieces 3 are preferably secured to the bedboard 1 by connection screws.

Additionally, this structure also includes multiple washers 7. The multiple washers 7 are located on the top surface of the two boards 6 and above disc sleeves 5. The washers are fastened in their respective locations by matching washer 7 to disc sleeve 5 via bolts through the board 6.

The fixed structure is simple. Reliable connection is achieved through the planks of the disc sleeve being fixed to the underside of the mattress. A bed plate setting corresponds to the position of the guide pieces, and the disc sleeves are connected with the guide pieces through the "stem" shaped slider. The bottom of the slider inserts into the guide piece T-shaped slot. The top of the slider extends into the disc sleeve through threading, securing the mattress to the bedplate.

During the mattress securing process the slider is initially screwed in the bottom surface of the disc sleeve. Then the mattress is aligned with the matching side of the bed board and then slid toward one side.

When more than one slider at the bottom connects with the matching multiple T-shaped grooves of the guide pieces, the mattress can be fixed to the bed plate. Separation can be handled by sliding the mattress in the reverse direction. Multiple sliders slide out of the T-shaped slot of the of guide pieces, and then the mattress and bed board can be separated.

At the same time, because the slider and the disk sleeve have a threaded connection, the disc sleeve, through the planks, are fixed to the underside of the mattress. The mattress in the installed position has a traction effect, and therefore avoids an S-shape mattress when the bed board is rising.

In addition, the planks can be embedded into the mattress with wood adhesives. Then the sponge can cover the structure. Also, the inner ring of the disc sleeve threads are situated at hollow part of the sponge so that the slider can be easily screwed into it.

The structure of the fixed guide pieces is made according to the size of the bed and the bed carrying capacity between the mattress and the bed board.

Preferably, the quantity of connectors among the guide piece slider and disc sleeves are at least four or more, to give the mattresses a reliably smooth connection to the bedplate. Once affixed the connection structure is hidden so that the mattress appearance is clean. The fixed structure has hidden connections, the mattress has clean a and beautiful appearance and is convenient to install and affix to provide the mattress and bed board a close fit without relative sliding.

The "stem" shaped sliders 4 preferably terminate at a bulbous downwardly facing mushroom shaped head that has a rounded bottom portion for ease of insertion into the channel of the guide pieces.

The invention claimed is:

1. An electric bed bedboard with embedded fixed structure is characterized in that the fixed structure comprises:

an electric bed having a hinged multi-piece bedplate;

a plurality of guide pieces mounted to the bed plate;

a plurality of sliders;

a plurality of disc sleeves each comprising an inner ring, and two boards;

wherein each of the guide pieces are mounted to the bedplate and have a top open surface T-slot; wherein the two boards connect to the sleeve inner rings and the plurality of disc sleeves complements the plurality of sliders, wherein each of the sliders comprises a stem, wherein the plurality of sliders and plurality of guide pieces make connection at the top open surface T-slots, and wherein the plurality of disc sleeves are connected to the stems by a threaded connection.

2. The electric bed bedboard with embedded fixed structure of claim 1, wherein the there are two guide pieces, namely a first guide piece and a second guide piece; wherein there are two sliders, namely a first slider and a second slider; and wherein there are two disc sleeves, namely a first disc sleeve and a second disc sleeve, wherein the first guide piece and the second guide piece are arranged along an edge of the bed mattress.

3. The electric bed bedboard with embedded fixed structure of claim 1, wherein the electric bed bedboard with embedded fixed structure has the T-shaped slot at one end of each guide piece.

4. The electric bed bedboard with embedded fixed structure of claim 1, further comprising: a plurality of the washers located at the top surface of the two boards to complement the position of the plurality of disc sleeves through a fastened bolt between the washer and the disc sleeve.

5. The electric bed bedboard with embedded fixed structure of claim 1, wherein the two boards are made of wood, wherein the there are two guide pieces, namely a first guide piece and a second guide piece; wherein there are two sliders, namely a first slider and a second slider; and wherein there are two disc sleeves, namely a first disc sleeve and a second disc sleeve, wherein the first guide piece and the second guide piece are arranged along an edge of the bed mattress.

6. The electric bed bedboard with embedded fixed structure of claim 5, wherein the electric bed bedboard with embedded fixed structure has the T-shaped slot at one end of each guide piece.

7. The electric bed bedboard with embedded fixed structure of claim 5, further comprising: a plurality of the washers located at the top surface of the two boards to complement the position of the plurality of disc sleeves through a fastened bolt between the washer and the disc sleeve.

* * * * *